US007542822B2

(12) United States Patent
Kawaguchi et al.

(10) Patent No.: US 7,542,822 B2
(45) Date of Patent: Jun. 2, 2009

(54) COMPLEX DATA PROCESSING DEVICE AND COMPLEX DATA PROCESSING METHODS

(75) Inventors: Yasuhiko Kawaguchi, Nagoya (JP); Atsuya Hayakawa, Chita (JP); Hirokazu Nakashima, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 536 days.

(21) Appl. No.: 11/339,517

(22) Filed: Jan. 26, 2006

(65) Prior Publication Data

US 2006/0167581 A1 Jul. 27, 2006

(30) Foreign Application Priority Data

Jan. 27, 2005 (JP) ..... 2005-019964

(51) Int. Cl.
*D05C 5/02* (2006.01)

(52) U.S. Cl. ..... 700/138; 700/136; 112/102.5; 112/475.18

(58) Field of Classification Search ..... 700/130, 700/131, 133, 136–138; 112/102.5, 475.01, 112/475.04, 475.05, 475.18; 101/481, 483, 101/485, 486
See application file for complete search history.

(56) References Cited

U.S. PATENT DOCUMENTS 5,144,899 A * 9/1992 Allen ..... 112/470.05
5,927,220 A 7/1999 Zheng et al.
6,435,117 B2 * 8/2002 Codos et al. ..... 112/470.05
2004/0154512 A1 * 8/2004 Krasnitz ..... 112/475.18
2004/0221783 A1 * 11/2004 Niimi ..... 112/475.01
2005/0015177 A1 * 1/2005 Hagino et al. ..... 700/132
2007/0022930 A1 * 2/2007 Hagino et al. ..... 112/102.5

FOREIGN PATENT DOCUMENTS

JP A-10-137470 5/1998
JP A-11-076662 3/1999
JP 2000034665 A * 2/2000
JP B2-3354414 9/2002

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

A complex data processing device that processes embroidery data representing an embroidery pattern to be formed on fabric by a sewing machine capable of embroidering and print data representing print pattern to be printed on the fabric by a printer. The complex data processing device includes a data acquiring unit that acquires the embroidery data and the print data, an overlapped region detecting unit that detects an overlapped region at which an embroidery region represented by the embroidery data and a printing region represented by the print data overlap based on the embroidery data and the print data acquired by the data acquiring unit, and a data modifying unit that deletes data corresponding to the overlapped region detected by the overlapped region detecting unit from at least one of the embroidery data and the print data.

20 Claims, 14 Drawing Sheets

COMPLEX DATA PROCESSING DEVICE AND COMPLEX DATA PROCESSING METHODS

CROSS-REFERENCE TO RELATED APPLICATION

This application is related to Japanese Patent Application No. 2005-019964, filed on Jan. 27, 2005. The entire subject matter of the application is incorporated herein by reference.

BACKGROUND

1. Technical Field

Aspects of the invention relates to a complex data processing device that processes embroidery data used in embroidering machines and print data used in printers in order to form an embroidery pattern and printed pattern on fabric.

2. Description of Related Art

Conventionally, embroidering machines which are configured to embroider figures on fabric in accordance with embroidery data including stitch data representing a plurality of needle drop points is known. Recently, a technique has been developed in which print data (bit map data) is developed based on the embroidery data, and the embroidery pattern can be formed by the printer.

For example, Japanese Patent Provisional Publication No. HEI 11-76662 (hereinafter, referred to as '662 publication) discloses a multi-function embroidery system which is configured as follows. The embroider system generates, using an embroidery image data generating program, by applying a dot data developing procedure for providing pixel dots at a predetermined density "1" inside an closed outline for each color component included in the embroidery data, embroidery image data (i.e., print data) containing developed color designating data and bit map data for each color component is generated.

For another example, Japanese Patent Publication No. 3354414 (hereinafter, referred to as '414 publication) disclosed a line segment assuming module including a first line segment assuming module and a second line segment assuming module, which executes an outline determining procedure based on the embroidery data, thereby extracting the outline of the embroidery pattern (i.e., embroidery region).

Based on the embroidery data generating technique disclosed in '662 publication and the outline extracting technique disclosed in '414 publication, it becomes possible to generate image displaying data used for displaying the embroidery pattern on a display or embroidery printing data used for printing the embroidery pattern on a recording medium.

Recently, printers that can print desired patterns/images on fabric have been developed and used. Using such printers, patterns/images can be printed on fabric (e.g., T-shirt). Further, there is a desire that, by forming embroidery patterns on the fabric on which the patterns/images are printed, goodness of printing and goodness of embroidering are harmonized, and fabric having excellent appearance and texture is obtained.

When patterns are formed on fabric by printing and embroidering, typically, printing is performed in accordance with image data, and then embroidering is performed in accordance with embroidery data. When the printed pattern and embroidery pattern are formed on fabric, if part of the printed pattern and the part of the embroidery pattern overlap, the following problem may arise. By embroidering, the fabric shrinks, and the printed pattern and the embroidered pattern are shifts with respect each other at the overlapped portion, which deteriorated the appearance of the resultant formed patterns.

Further, when the overlapped portion has a relatively wide area, and printing is performed first, although the printed pattern at the overlapped portion will be covered with the embroidery, the pattern is printed, which unnecessarily consumes ink and time.

Further, when the printing and embroidering are performed with respect to the fabric held on a frame, it is preferable to determined the order of the printing and embroidering may be determined in accordance with arrangement of an embroidering region and printing region, preference of a user, resultant appearance, and the like.

If the order is fixed in advance, that is, if it is fixed that the printing is performed first or the embroidering is performed first, the process lacks flexibility, and the user may not be always satisfied with the formed patterns.

SUMMARY OF THE INVENTION

Aspects of the invention are advantageous in that an improved complex data processing device is provided to generate the print data and the embroidery data, with which the above problem is solved.

BRIEF DESCRIPTION OF THE ACCOMPANYING DRAWINGS

FIG. 1 schematically shows a configuration of an embroidering and printing system including the complex data processing device according to aspects of the invention.

FIG. 2 is a block diagram of the complex data processing device provided in the embroidering and printing system shown in.

Figure 12A:
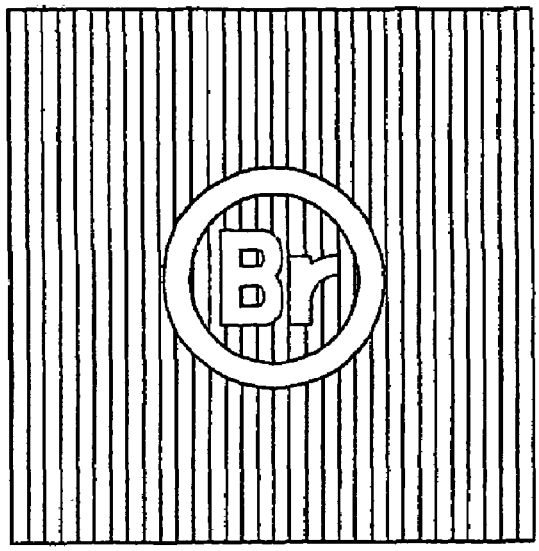
FIG. 12A illustrates an image represented by the print data in which the overlapped portion is deleted.
Figure 12B:
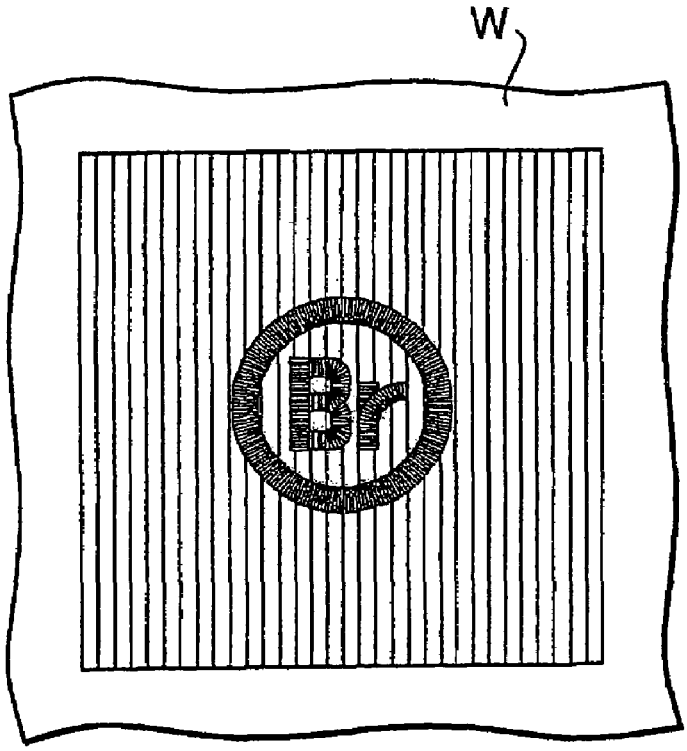

FIG. 12B a plan view of fabric on which the printing and embroidering operations have been performed.

Figure 13A:
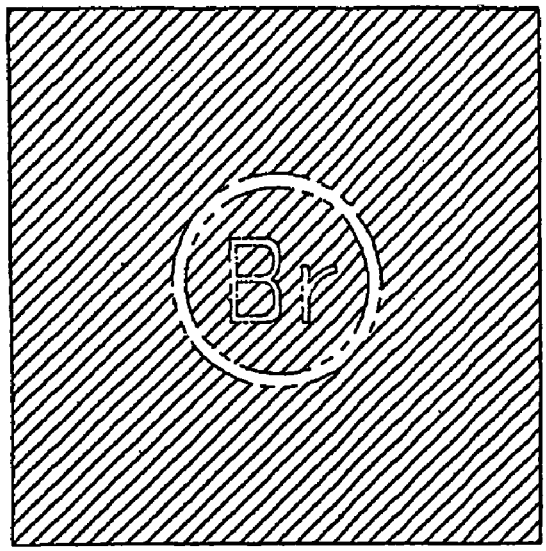

FIG. 13A shows the print data in which a width of the overlapped portion is reduced.

Figure 13B:
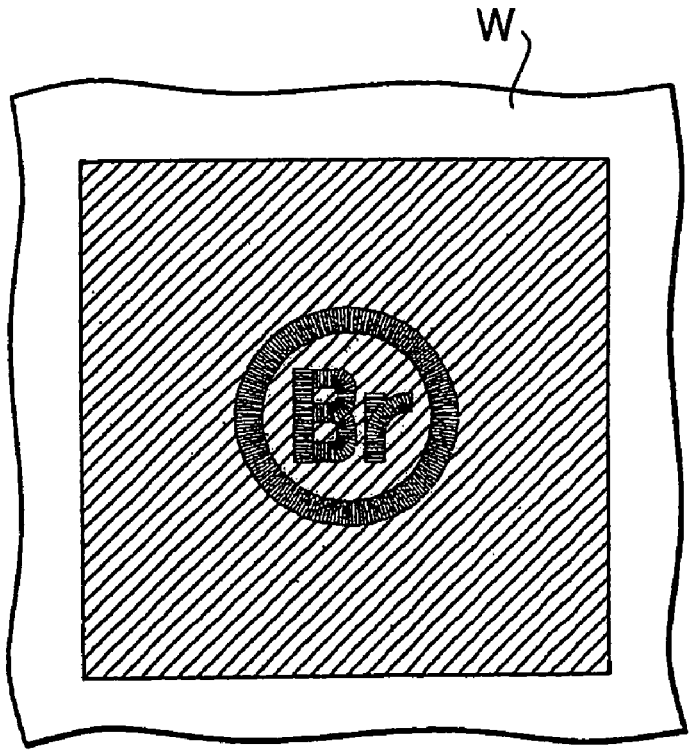

FIG. 13B shows a plan view of the fabric on which the printing and embroidering operations have been performed.

Figure 14A:
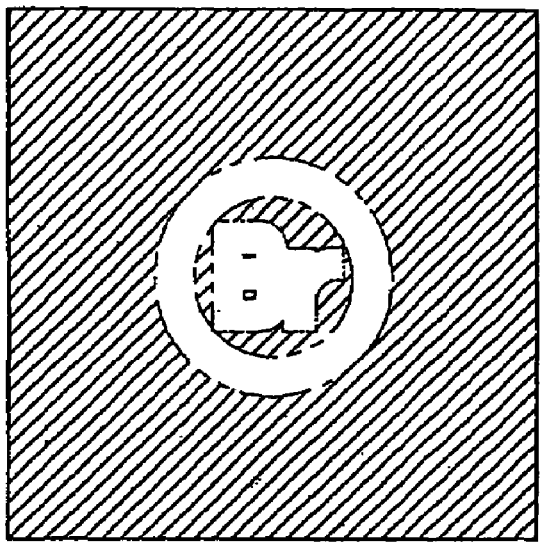

FIG. 14A shows the print data in which a width of the overlapped portion is increased.

Figure 14B:
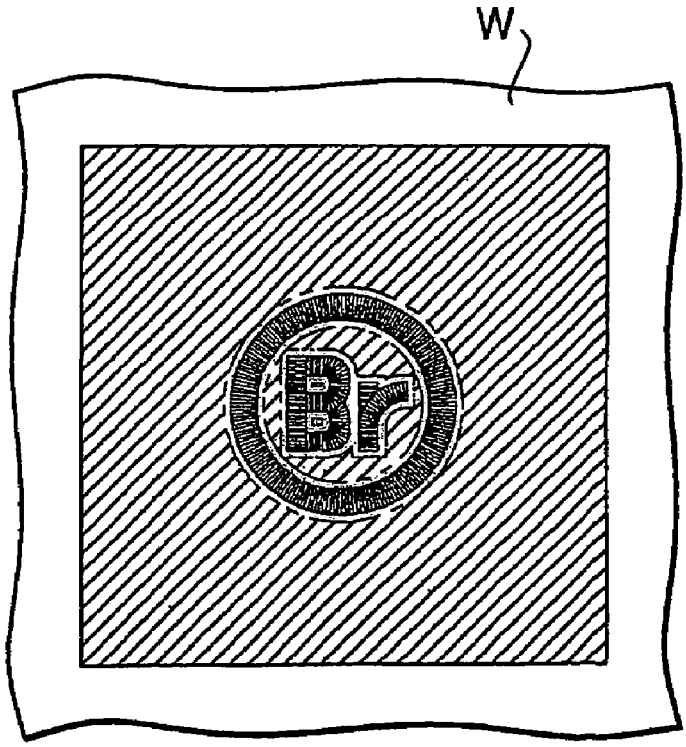

FIG. 14B shows a plan view of the fabric on which the printing and embroidering operations have been performed.

Figure 15A:
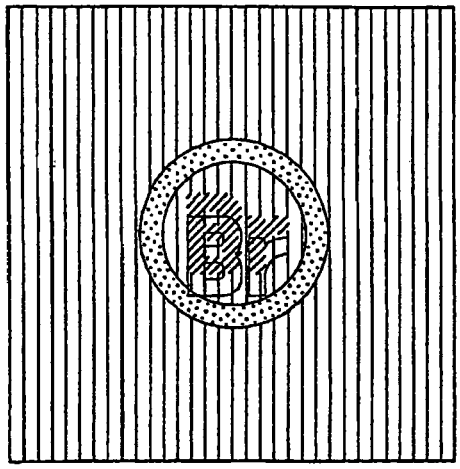

FIG. 15A illustrates the print data which prints a pattern that colors the overlapped portion to have the same color as the thread that forms the embroidery at the overlapped portion.

Figure 15B:
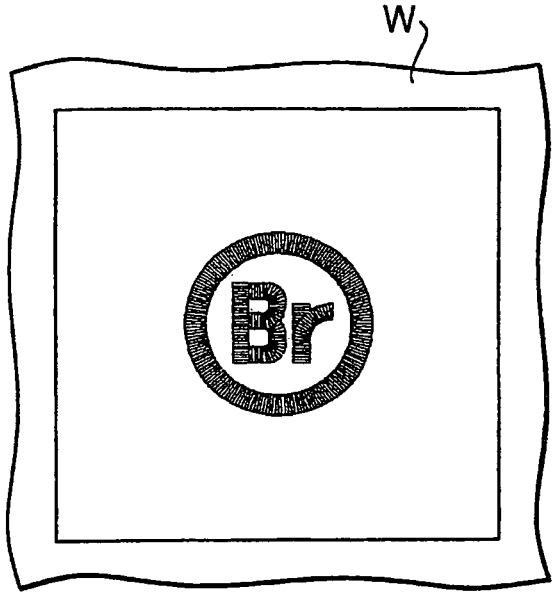

FIG. 15B is a plan view of the fabric on which the embroidery is formed with a white thread.

Figure 15C:
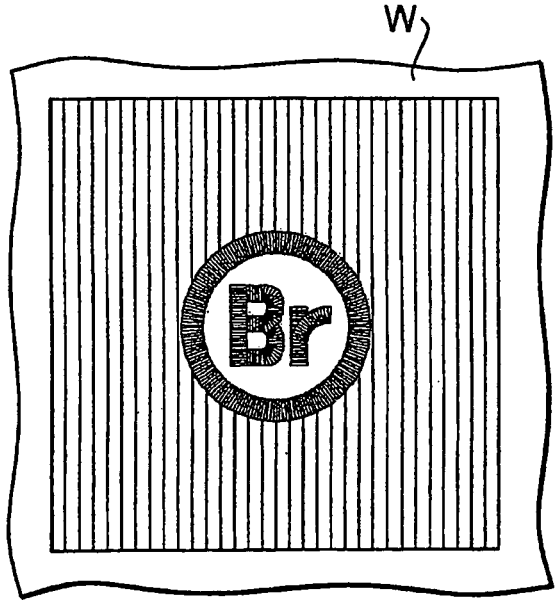

FIG. 15C is a plan view of the fabric on which the embroidering process and printing process are performed.

Figure 16:
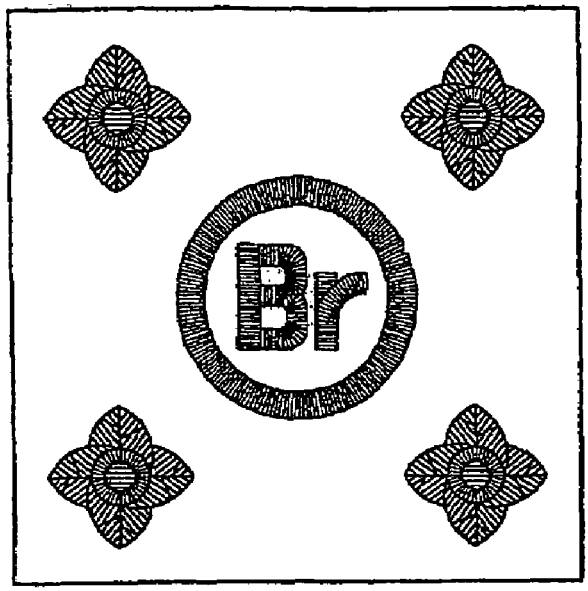

FIG. 16 shows an exemplary configuration of the embroidery data.

Figure 17:
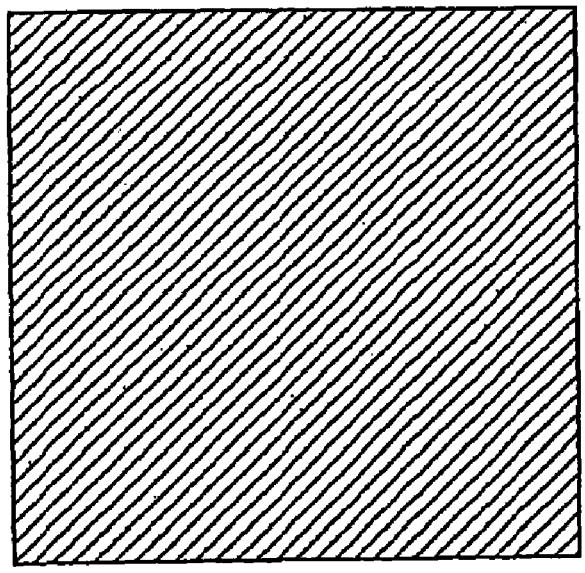

FIG. 17 shows an exemplary configuration of the print data.

Figure 18A:
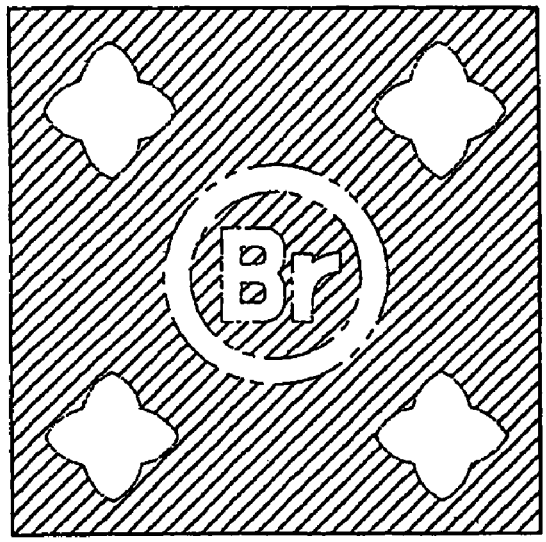

FIG. 18A illustrates an image represented by print data in which print data corresponding to a plurality of overlapped regions is deleted.

Figure 18B:
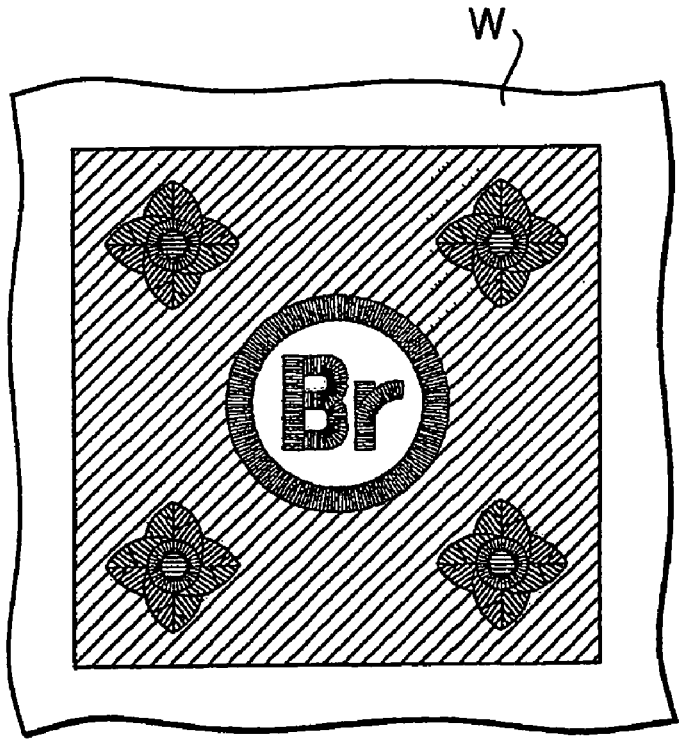

FIG. 18B is a plan view of the fabric on which the printing and embroidering have been performed.

Figure 19A:
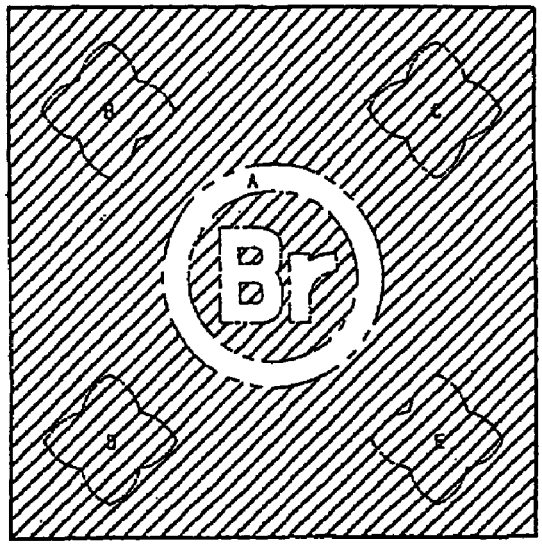

FIG. 19A illustrates an image represented by print data in which part of print data corresponding to an overlapped region is deleted.

Figure 19B:
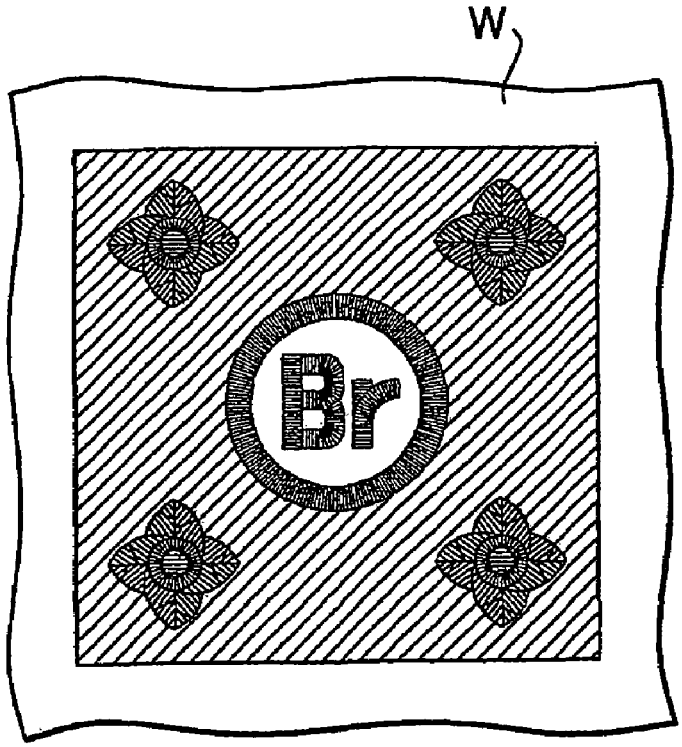

FIG. 19B is a plan view of the fabric on which the printing and embroidering have been performed.

DETAILED DESCRIPTION

General Overview

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

According to aspects of the invention, there is provided a complex data processing device that processes embroidery data representing an embroidery pattern to be formed on fabric by a sewing machine capable of embroidering and print data representing print pattern to be printed on the fabric by a printer. The complex data processing device includes a data acquiring unit that acquires the embroidery data and the print data, an overlapped region detecting unit that detects an overlapped region at which an embroidery region represented by the embroidery data and a printing region represented by the print data overlap based on the embroidery data and the print data acquired by the data acquiring unit, and a data modifying unit that deletes data corresponding to the overlapped region detected by the overlapped region detecting unit from at least one of the embroidery data and the print data.

The data modifying unit may modify the print data such that overlapped region print data corresponding to the overlapped region is deleted from the print data.

The data modifying unit may include a first overlapped region setting unit. When the overlapped region detecting unit detects multiple overlapped regions, the first overlapped region setting unit may set whether overlapped region print data corresponding to each of multiple overlapped regions is to be deleted from the print data.

The data modifying unit may modify the embroidery data such that overlapped region embroidery data is deleted from the embroidery data.

The data modifying unit may include a second overlapped region setting unit. When the overlapped region detecting unit detects multiple overlapped regions, the second overlapped region setting unit may set whether overlapped region embroidery data corresponding to each of multiple overlapped regions is to be deleted from the embroidery data.

The data modifying unit may delete the overlapped region print data from the print data so that a width of the overlapped region is modified by a predetermined amount in one of a direction where the overlapped region is reduced and a direction where the overlapped region is expanded.

The data modifying unit may delete the overlapped region embroidery data from the embroidery data so that a width of the overlapped region is modified by a predetermined amount in one of a direction where the overlapped region is reduced and a direction where the overlapped region is expanded.

According to aspects of the invention, there is provided a complex data processing device that processes embroidery data representing an embroidery pattern to be formed on fabric by a sewing machine capable of embroidering and print data representing print pattern to be printed on the fabric by a printer. The complex data processing device may include a data acquiring unit that acquires the embroidery data and the print data, an overlapped region detecting unit that detects an overlapped region at which an embroidery region represented by the embroidery data and a printing region represented by the print data overlap based on the embroidery data and the print data acquired by the data acquiring unit, and a process order setting unit allowing a user to set the order of embroidering based on the embroidery data and printing based on the print data when the overlapped region detecting unit detects the overlapped region, the processing order setting unit storing the order set by the user.

The complex data processing device may further include a data modifying unit configured to delete overlapped region print data corresponding to the overlapped region from the print data if it is set through the process order setting unit that the printing is performed prior to the embroidering.

The complex data processing device may further include a thread density compensating unit configured to modify the embroidery data to change a thread density at the overlapped region, the thread density compensating unit modifying the embroidery data to increase the thread density of the embroidery at the overlapped region if it is set through the process order setting unit that the printing is performed prior to the embroidering.

According to aspects of the invention, there is provided a computer program product comprising computer readable instructions that cause the computer to serve as each of the complex data processing devices described above.

Embodiment

Hereinafter, referring to the accompanying drawings, a data processing device according to an illustrative embodiment of the invention will be described.

Figure 1:
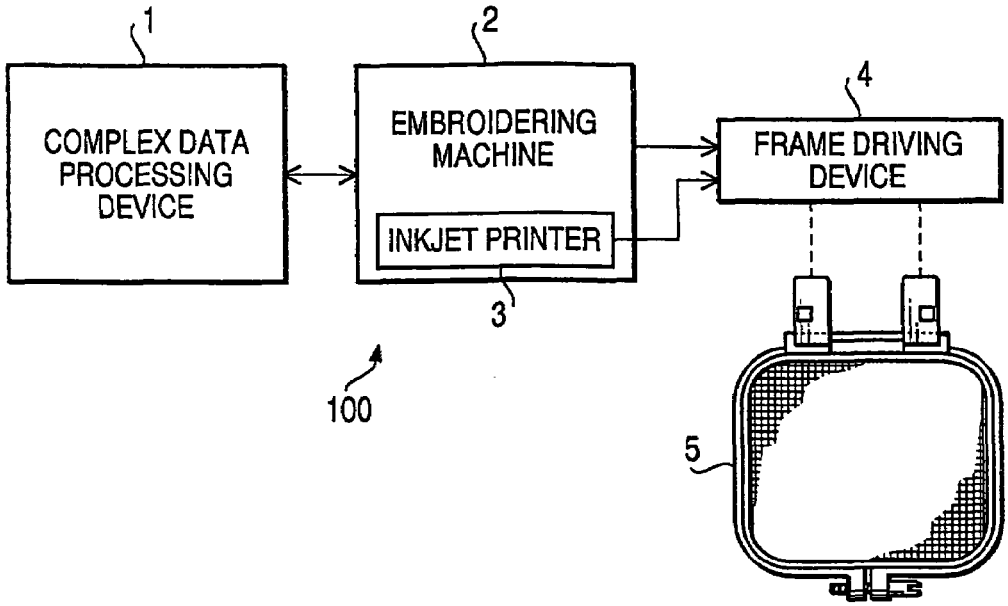
FIG. 1.

FIG. 1 schematically shows a configuration of an embroidering and printing system 100 including a complex data processing device 1, an embroidering machine 2 and a frame driving device 4. In the system 100, the complex data processing device 1 is electrically connected to the embroidering machine 2 having an inkjet printer 3, and the frame driving device 4 is connected to the embroidering machine 2. Various types of embroidery frames 5 can be selectablly and detachably attached to the frame driving device 4.

The frame driving device 4 is configured to move the embroidery frame 5, in two directions intersecting at right angles, for an embroidery operation to be executed by the embroidering machine 2 and a printing operation to be executed by the inkjet printer 3.

Figure 2:
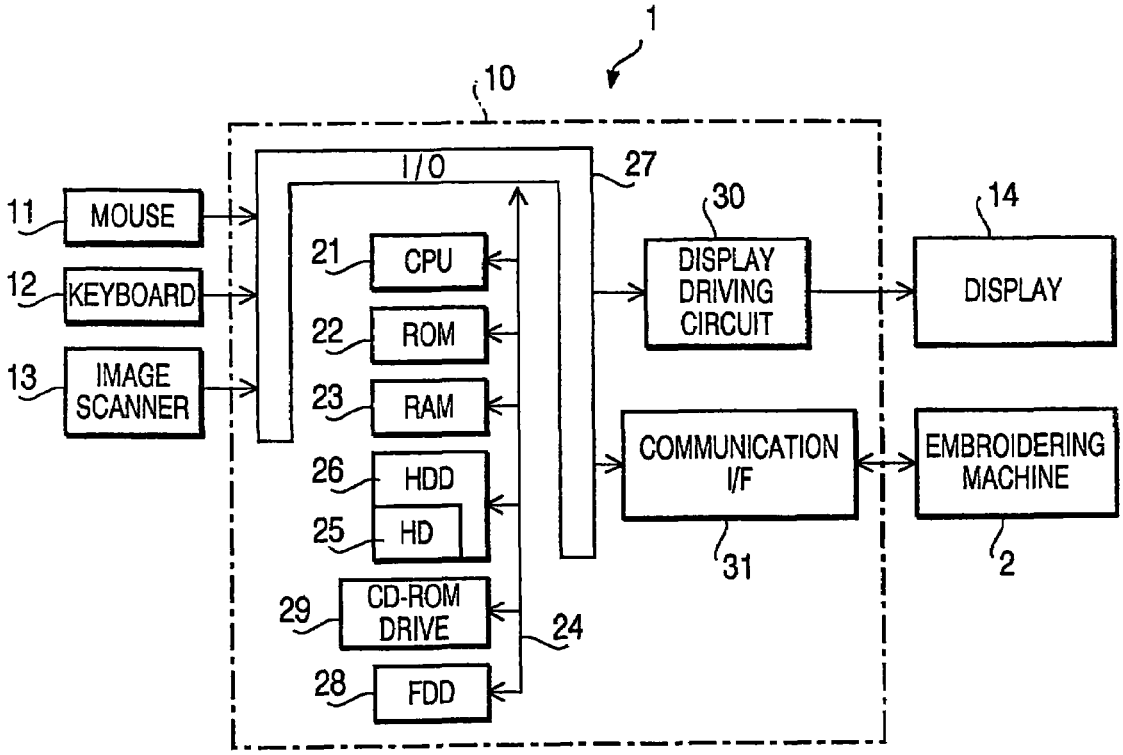
Figure 3:
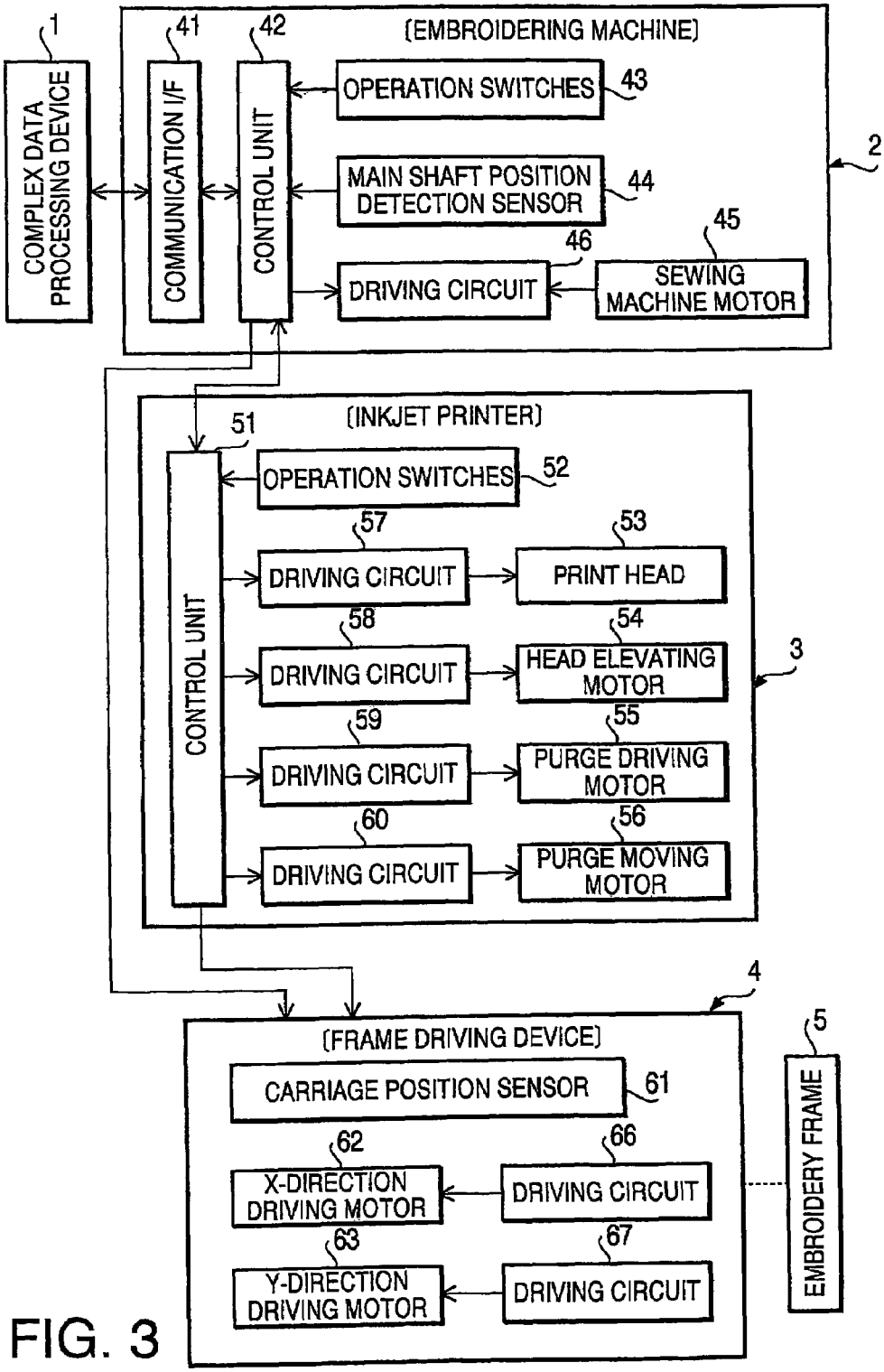
FIG. 3 shows a block diagram of the embroidering machine, the inkjet printer and the frame driving device according to aspects of the invention.

FIG. 2 is a block diagram of the complex data processing device 1 which is constituted by a personal computer. As shown in FIG. 2, the complex data processing device 1 includes a control unit 10, a mouse 11 connected to the control unit 10, a keyboard 12, an image scanner 13 and a display 14. The control unit 10 includes a microcomputer having a CPU (central processing unit) 21, a ROM 22, and a RAM 23, which are connected to each other via a bus 24. The control unit 10 further includes a hard disk drive (HDD) 26 having a hard disk (HD) 25 and an input/output (I/O) interface 27.

A flexible disk drive (FDD) 28 and a CD-ROM drive 29 are also connected to the bus 24. The mouse 11, the keyboard 12, the image scanner 13, a display driving circuit 30 for driving the display 14, and a communication interface 31 interfacing the control unit 10 with the embroidering machine 2 are connected to the I/O interface 27.

In the ROM 22, various types of programs, such as a start up program for starting up the personal computer (the complex data processing device 1), are stored. In the RAM 23, an image data memory area for storing image data of printing patterns read by the image scanner 13 or read from a flexible disk or a CD-ROM, an embroidery data memory area for storing embroidery data of embroidery patterns, areas for storing results of calculating operations of the CPU 21, buffer areas, pointer areas, counter areas, and the like are allocated, and these areas are used on an as needed basis.

On the hard disk 25, an operating system, drivers for the mouse 11, keyboard 12, the image scanner 13 and the display 14, application programs and the like are stored. A control program for obtaining image data or embroidery data from the image scanner 13, the flexible disk, or the CD-ROM, a data input/output control program for storing the image data or the embroidery data in the image data memory area or the embroidery data memory area, a control program for embroidery data processing are also stored in the hard disk 25. Print data or embroidery data may be stored in the hard disk 25.

Each piece of the embroidery data includes an embroidery pattern number, stitch data for each embroidery pattern section, and thread cut data. Further, in each of a plurality of embroidery pattern sections constituting an embroidery pattern, thread color data, feed data and the like are included. Data may be imported through the image scanner 13, flexible disk, CD-ROM using data importing programs.

The embroidering machine 2 includes a control unit 42, a switch unit 43 having various types of switches, a main shaft position sensor 44, a sewing machine motor 45 and a driving circuit 46 for the sewing machine motor 45. The control unit 42 is connected to the complex data processing device 1 via a communication I/F 41. By rotations of the sewing machine motor 45, a main shaft (not shown) is rotated. The rotations of the main shaft cause a needle bar up-and-down driving mechanism (not shown) to move a needle bar up and down. By cooperation of the up and down movement of a sewing needle of the needle bar and a thread taker mechanism (not shown) provided in a bed portion, embroidery stitches are formed on fabric W held by the embroidery frame 5.

The inkjet printer 3 includes a control unit 51, a switch unit 52 having various types of switches, a print head 53 in which nozzles for four colors (cyan, magenta, yellow and black) are arranged in four rows, a head elevating motor 54, a purge driving motor 55, a purge moving motor 56, driving circuits 57, 58, 59 and 60 provided for the print head 53, the head elevating motor 54, the purge driving motor 55 and the purge moving motor 56, respectively. When the print head 53 receives a print command from the control unit 51, the print head 53 operates to eject ink downwardly to the fabric W through use of deformation of a piezoelectric ceramic actuator.

The frame driving device 4 includes a carriage position sensor 61, an x-direction driving motor 62 for moving the embroidery frame 5 in an x-direction, a y-direction driving motor 63 for moving the embroidery frame 5 in a y-direction, driving circuits 66 and 67 provided for the x-direction driving motor 62 and the y-direction driving motor 63, respectively. When the frame driving device 4 receives a frame movement command signal from the control unit 42 of the main body 2*a* of the embroidering machine 2 or the control unit 51 of the inkjet printer 3, the frame driving device 4 drives the x-direction motor 62 and the y-direction motor 63 to move the embroidery frame 5 in the x and y directions.

Hereafter, procedures for embroidery data to be executed by the control unit 10 of the complex data processing device 1 will be described with reference to flowcharts shown in FIGS. 4-8. In the following description, "Si" (i=11, 12, 13, . . . ) represents a step number.

Figure 4:
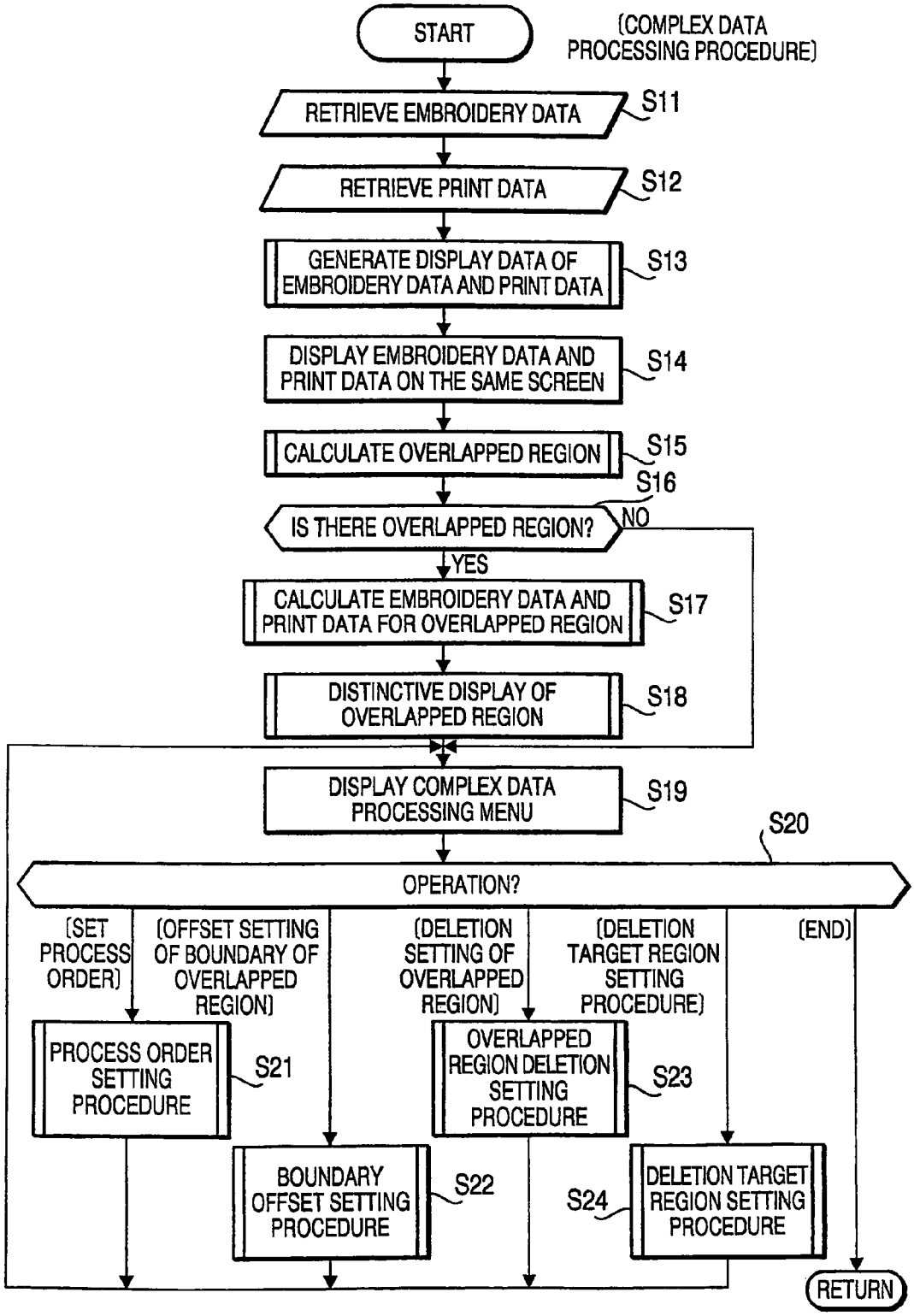
FIG. 4 is a flowchart illustrating a procedure of a first data processing according to aspects of the invention.

Although not shown, on the display 14 a main menu is displayed, and when a user selects a "complex data procedure" in the main menu, the complex data procedure shown in FIG. 4 is executed. When the complex data procedure is started, user's desired embroidery data (see FIG. 9) is retrieved from the RAM 23 and hard disk 25 (S11), and further print data (see FIG. 10) corresponding to the desired (selected) embroidery data is retrieved (S12).

Figure 11:
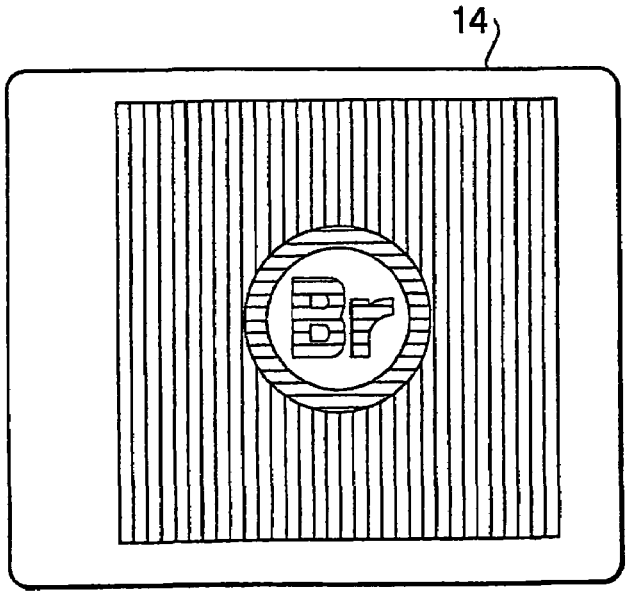
FIG. 11 shows an exemplary image showing a distinctive indication of the overlapped region according to aspects of the invention.

Next, based on the retrieved embroidery data, embroidery pattern display data which is an onscreen representation of the embroidery data is generated, and print pattern display data which is an onscreen representation of the print data is generated (S13) based on the retrieved print data. Then, the embroidery pattern and the print pattern are displayed on the display 14 in an overlapped state (S14) as shown in FIG. 11. Next, an overlapped region of the embroidery pattern and print pattern when the embroidery data and the print data are aligned on the same coordinate is detected (S15).

If there is the overlapped region (S16: YES), the control proceeds to S17 and operates to obtain embroidery data for overlapped region and print data for overlapped region (S17). Next, the control operates to obtain overlapped region display data corresponding to one of the embroidery data for overlapped region and print data for overlapped region, and distinctively displays the overlapped region on the display 14 based on the thus obtained overlapped region display data (see FIG. 11) in S18.

In S19, a complex data procedure menu for executing the embroidery and printing on the fabric W held by the frame 5 by combining the embroidery data and the print data is displayed on the display 14. The user then selects a desired item of the procedure menu using the mouse 11. If an item "process order setting" is selected in S20, the control proceeds to S21 and execute the process order setting procedure (see FIG. 5).

When the process order setting procedure (FIG. 5) is executed, the control judges whether a PS flag is set or an SP flag is set (S31). The PS flag is set when the printing is executed first and then the embroidering is executed (i.e., a print priority mode), while the SP flag is set when the embroidering is executed and then the printing is executed (i.e., an embroidery priority mode). If the PS flag is set, the control proceeds to S32 and sets the SP flag (and releases the PS flag). If the SP flag is set, the control proceeds to S33 and sets the PS flag, releases the SP flag.

If there is an overlapped region (S34: YES), and the printing is performed in the overlapped region (S35: YES), the control changes the print data for the overlapped region such that the color of the overlapped region is similar to the color of the thread attributed in the embroidery data for the overlapped region (S36). Then, the control returns to S19 of FIG. 4.

Figure 5:
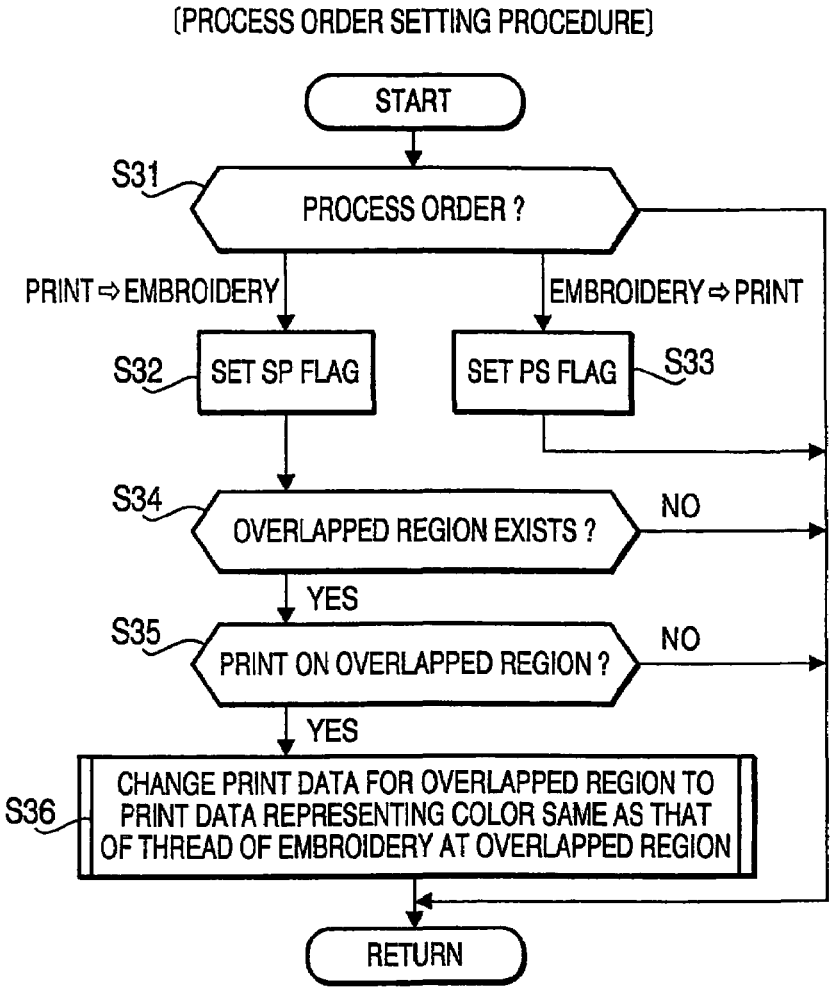
FIG. 5 is a flowchart illustrating an order determining procedure according to aspects of the invention.
Figure 6:
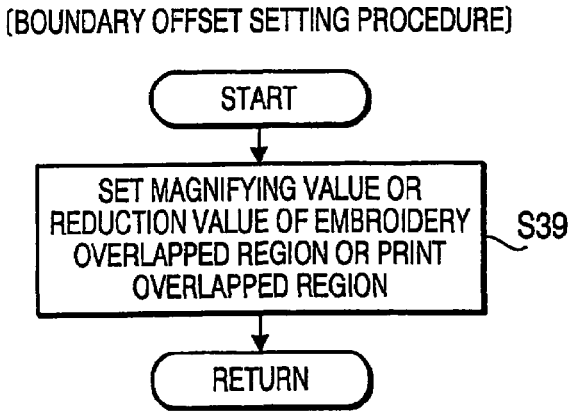
FIG. 6 shows a flowchart illustrating a boundary offset setting procedure according to aspects of the invention.

If, in S31 of FIG. 5, the control determines that the SP flag is set (i.e., the embroidery priority mode is set), the control sets the PS flag (i.e., the print priority mode is set) in S33, and finishes the process order setting procedure. It should be noted that the control also finishes the process order setting procedure if there are no overlapped regions (S34: NO) or the printing is not performed on the overlapped regions (S35: NO).

Back to FIG. 4, if an item "overlapped region boundary offset setting" is selected in S20, the control proceeds to S22 and executes the overlapped region boundary offset setting procedure (see FIG. 6) is executed.

When the overlapped region boundary offset setting procedure is started, the control displays a boundary offset value setting window on the display 14. The user selects one of the embroidery overlapped region and print overlapped region, a magnifying value for increasing the width of the region or a reduction value for decreasing the width using the mouse/ten key 11 (S39).

Next, if an item "overlapped region deletion setting" is selected from the menu (S20), an overlapped region deletion setting procedure (FIG. 7) is executed (S23).

Figure 7:
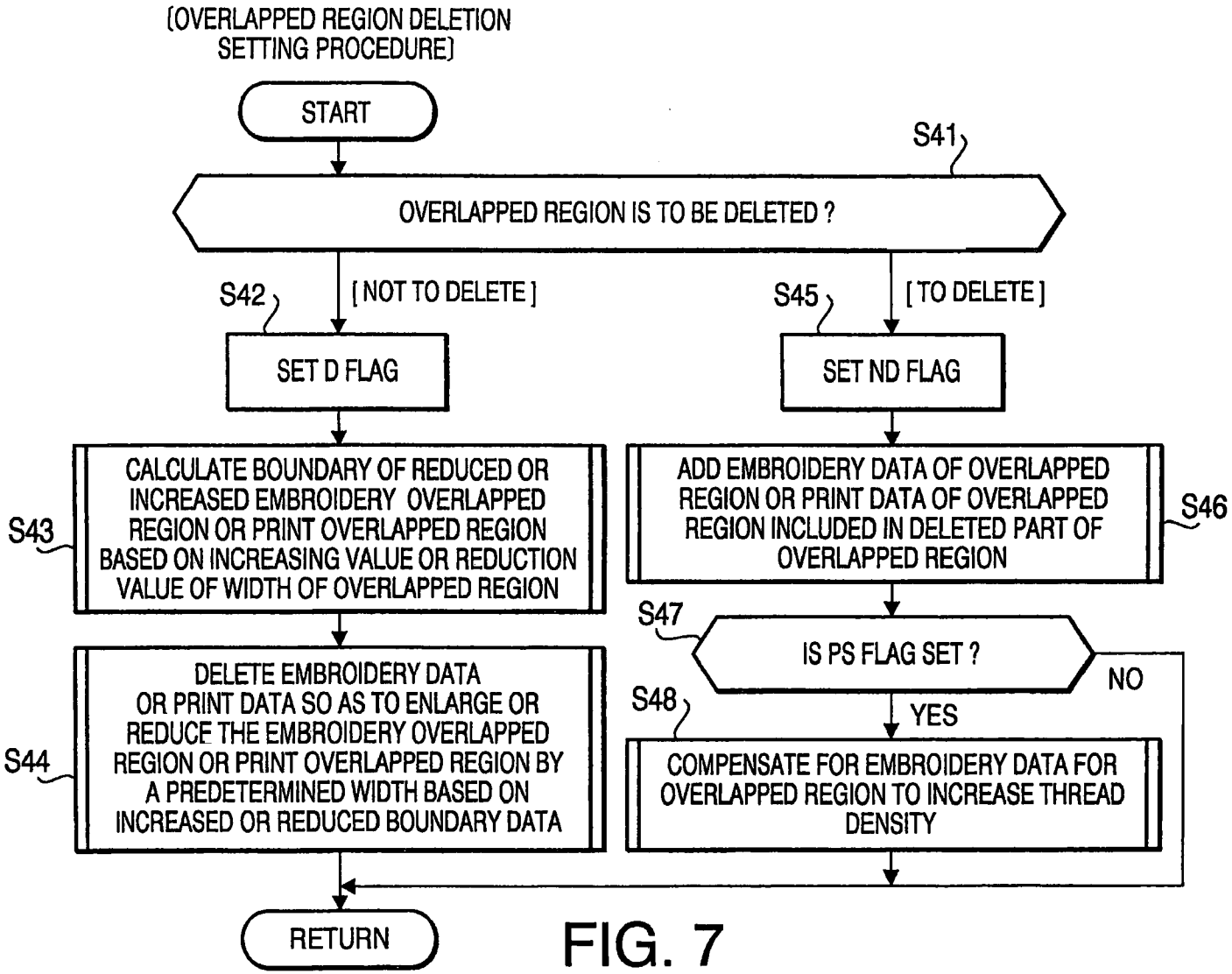
FIG. 7 shows a flowchart illustrating an overlapped region deletion setting procedure according to aspects of the invention.

As shown in FIG. 7, when the overlapped region deletion setting procedure is started, the control judges whether the overlapped region is to be deleted in S41. If an ND flag is currently set (which means that the embroidery data or print data for the overlapped region will not be deleted: non-deletion mode), a D flag (which represents deletion of the embroidery data or the print data) is set in S42 (i.e., the deletion mode is set).

The boundary offset has already been set, based on the increasing vale or the reduction value of the width of the overlapped portion, the control operates a boundary line of the magnified or reduced print overlapped region (S43). Next, based on the thus obtained boundary data, the control deletes the embroidery data or the print data so that the width of the embroidery overlapped region or the print overlapped region is changed (increases or decreases) by a predetermined amount (S44). Then, the control finishes the overlapped region deletion setting procedure shown in FIG. 7, and returns to S19 of FIG. 4.

If the D flag (which represents that the embroidery data of the print data or print data in the overlapped region is to be deleted) is set (i.e., the deletion mode), the control sets the ND flag is set (i.e., the non-deletion mode is set) in S45. In this case, if the embroidery data or the print data included in the overlapped region has been deleted, the embroidery data or the print data once deleted is restored (added) in S46.

Then, if the PS flag has been set (i.e., the print priority mode) (S47: YES), the overlapped region embroidery data is compensated such that the thread density is increased (S48), and then the control finishes the procedure. Even if the printing has been executed in the overlapped portion where the embroidery is to be formed, by increasing the thread density, the printed color/pattern at the overlapped portion is covered with the embroidery.

If an item "target deletion region setting" is selected from the menu in S20 of FIG. 4, and if there are multiple overlapped regions, a target deletion region setting procedure (FIG. 8) is executed to set whether the embroidery data or the print data for the multiple overlapped regions should be deleted individually (S24).

Figure 8:
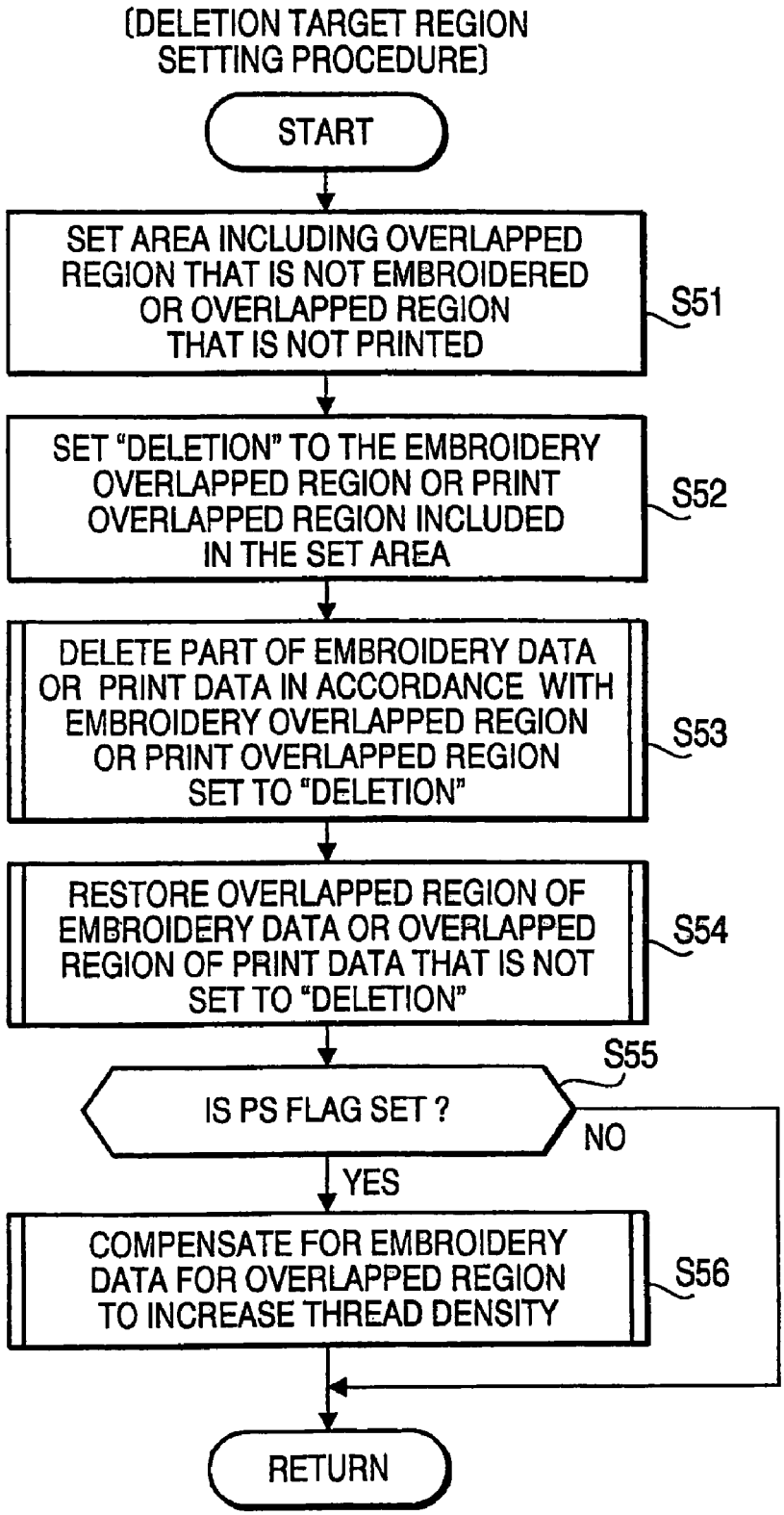
FIG. 8 shows a flowchart illustrating a target deletion region setting procedure according to aspects of the invention.

When the target deletion region setting procedure shown in FIG. 8 is started, user can set, using the mouth 11, an area including the overlapped regions in which the embroidering or printing is not executed, for multiple overlapped regions displayed on the display 14 (S51). Then, each of the embroidery overlapped regions or print overlapped regions are set to be deleted (S52).

In S53, corresponding to the embroidery overlapped regions or the print overlapped regions set to be deleted, the embroidery data of the overlapped portions or the print data of the overlapped portions are deleted (S53). It should be noted, however, corresponding to the embroidery regions and the print regions which are set not to be deleted, the embroidery data of the overlapped portions and the print data of the overlapped portions are restored in S54.

If the PS flag is set (i.e., the print priority mode is set) (S55: YES), the control compensates for the embroidery data of the overlapped regions such that the thread density is higher than the current density (S56). Then the control finishes the procedure shown in FIG. 8, and returns to S19 of FIG. 4. Although the printing has been performed in the overlapped region, by increasing the thread density of the embroidery, the printed color/pattern in the overlapped region can be covered with the embroidery.

If an item "end" is selected from the menu in S20 of FIG. 4, the control finishes the complex data processing procedure and returns to the main routine. Thereafter, based on the thus generated embroidery data and modified print data, the embroidering machine 2 is controlled to form the embroidery on the fabric W held by the frame 5, and the inkjet printer 3 is controlled to print the print pattern on the fabric W held by the frame 5.

Figure 9:
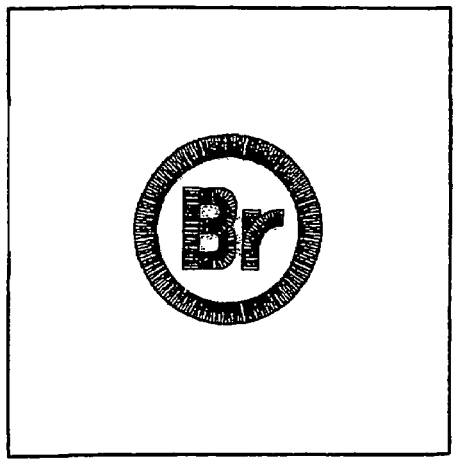
FIG. 9 shows an exemplary configuration of embroidery data.
Figure 10:
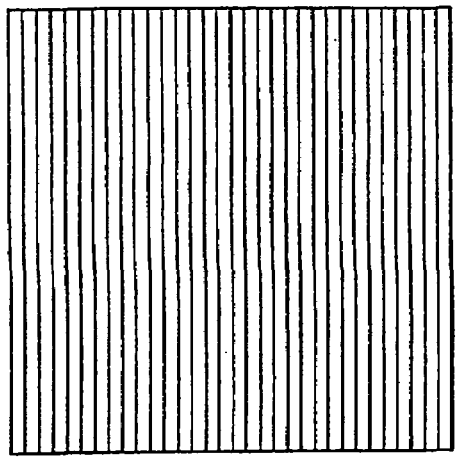
FIG. 10 shows an exemplary configuration of print data.

The complex data processing device according to aspects of the invention will be described further using an example where embroidery data representing a logo mark shown in FIG. 9, and print data representing the vertically-striped pattern shown in FIG. 10 are used. In this case, when the onscreen representation of the embroidery data and the onscreen representation of the print data are displayed on the display 14 in S14, an image as shown in FIG. 11 is obtained. That is, the logo mark is displayed at a central portion of the vertical-striped pattern. In accordance with the step in S18, the overlapped portion (which is the embroidery pattern portion, in this example) is indicated with blinking or striking colors.

When the PS flag is set in S21 (i.e., the print priority mode is set), the print data of the overlapped region corresponding to the embroidery data is deleted in S23 (see FIG. 12A). Then, as shown in FIG. 12B, after the image is printed based on the print-data corresponding to FIG. 12A on the fabric W with the inkjet printer 3, the embroidery is formed with the embroidering machine 2.

As above, in the print priority mode, if the there is an overlapped region where the embroidery region and the print region overlap, the print data is modified such that the print data corresponding to the overlapped region is deleted. Therefore, when the inkjet printer 3 operates to print a print pattern/image, unnecessary consumption of the ink at the overlapped region can be suppressed, and the consumption of the time for the unnecessary printing can also be suppressed.

In the print priority mode is set in S21, and in S39, the reduction value (e.g., 0.5 mm) for reducing the width of the print overlapped region is set, the print data for the overlapped region of which the width is reduced is deleted from the print data in S44 as shown in FIG. 13A. The, as shown in FIG. 13B, the printing is performed on the fabric W held by the frame 5 with the inkjet printer 3, and then the embroidery is formed with the embroidering machine 2.

As above, in the print priority mode, when the print data corresponding to the overlapped region is deleted, the width of the overlapped region is changed by a predetermined amount in a direction where the overlapped region is reduced. Therefore, even if the fabric shrinks due to the embroidering, a clearance gap is not formed between the embroidery and the printed region, which provides the excellent appearance of the resultant products.

If the print priority mode is set, and an increasing value (e.g., 1.0 mm) is set for increase the width of the print overlapped region, as shown in FIG. 14A, the print data of the overlapped region is deleted from the print data in S44. Then, as shown in FIG. 14B, based on the print data from which the overlapped region is deleted, the inkjet printer 3 prints the pattern on the fabric W held by the frame 5, and thereafter, the embroidering machine 2 forms the embroidery based on the embroidery data.

In this example, since the width of the overlapped portion of the print data is changed by a predetermined amount in a direction where the overlapped region is exanded, a clearance is formed between the embroidery pattern and the printed pattern, which provides tree-dimensional appearance.

When the embroidery priority mode is set in S21, and when the user embroiders the logo mark (embroidery pattern) using a white thread regardless of the thread color data (i.e., color change instruction) included in the embroidery data, the print data is changed as follows. Regarding the overlapped region, the color of the print data is changed in S36 to the colors same as the colors of the overlapped region of the embroidery data represents. In this example, an annular region in FIG. 15A is to be printed in red (which is represented by dots), and the characters "BR" are printed in green (which is represented by oblique lines).

With this configuration, as shown in FIG. 15B, even if the embroidery is formed using the white thread, by the printing operation afterward, the embroidered pattern is colored as if embroidered with colored threads in addition to the colored background.

As above, when the embroidery priority mode is selected, and the embroidery is formed prior to the printing, the print data of the overlapped region is changed to indicate the color same as that of the embroidery data. Therefore, if the embroidery at the overlapped region is formed with the white thread, the embroidery pattern can be colored with the same color originally intended. Therefore, without changing the thread when the color designation is made and with the printing, the embroidering and printing procedures can be completed relatively quickly and easily.

If the embroidery is not formed in the overlapped region, printing with the same color may substitute the embroidery pattern, which may shorten the embroidery process time.

Further example will be described hereafter. FIG. 16 shows exemplary embroidery data representing a logo mark and four leaf patterns, and FIG. 17 shows exemplary print data representing multiple oblique lines. In this example, the overlapped regions are logo mark and the four leaf patterns.

When the print priority mode is set in S21, and all the overlapped regions are set to be deleted in S24, the regions corresponding to the log mark and four leaf patterns are deleted from the print data as shown in FIG. 18A. Then, as shown in FIG. 18B, the printing is performed based on the print data, and then the embroidery patterns are formed on the fabric W held by the frame 5 by the embroidering machine 2.

If only the portion corresponding to the logo mark is deleted from the print data, as shown in FIG. 19A, only the print data of the overlapped region included in the logo mark is deleted. Then, the inkjet printer 3 prints the image on the fabric W held by the frame 5 based on the print data, and then the embroidering machine 2 embroiders based on the embroidery data.

As above, in the print priority mode, when the multiple overlapped regions exist, the user can determine whether the print data corresponding to the overlapped regions is deleted individually. Therefore, the user can take shrinking due to the embroidery into account and determines whether print data corresponding to each of the overlapped portions is to be deleted. Accordingly, at each overlapped region, the appearance of the resultant embroidery/print patterns can be improved.

If only the print data corresponding to the logo mark is set to be deleted, for the four leaf patterns which are not deleted, the embroidery data is compensated such that the thread density is increased in S56. As above, since the embroidery data is compensated such that the data corresponding to the overlapped portion (four leaf patterns) has a higher thread density, the color of the printed pattern at the overlapped portion can be covered with the embroidered pattern. Thus, the regardless of the printed color, the embroidered pattern can be formed with the intended thread color.

According to the illustrative embodiment, by the process order setting procedure (S21), the order of the embroidering and printing can be set. Therefore, if there are overlapped areas where both the printing and embroidering would be performed, the user can freely set the order taking the preference, size of the embroidery pattern and print pattern, arrangement of the embroidery pattern and print pattern, and resultant appearance, and the like into account.

It should be appreciated that the invention described with reference to the illustrative embodiment should not be limited to the configuration of the illustrative embodiment, but can be modified in various ways in accordance with aspects of the invention.

For example, in the illustrative embodiment, mainly in the print priority mode (where printing is performed based on the print data prior to embroidering), the print data of the overlapped region can be deleted. This may be modified such that, in the embroidery priority mode (where embroidering is performed based on the embroidery data prior to printing), the embroidery data of the overlapped region may be deleted.

In the illustrative embodiment, the increasing value or the reducing value is set by the user arbitrarily in S39. This configuration may be modified such that predetermined values of increasing value or reducing value (i.e., predetermined widths) may be set.

What is claimed is:

1. A complex data processing device that processes embroidery data representing an embroidery pattern to be formed on fabric by a sewing machine capable of embroidering and print data representing print pattern to be printed on the fabric by a printer, the complex data processing device comprising:

a data acquiring unit that acquires the embroidery data and the print data;

an overlapped region detecting unit that detects an overlapped region at which an embroidery region represented by the embroidery data and a printing region represented by the print data overlap based on the embroidery data and the print data acquired by the data acquiring unit; and a data modifying unit that deletes data corresponding to the overlapped region detected by the overlapped region detecting unit from at least one of the embroidery data and the print data.

2. The complex data processing device according to claim 1, wherein;

the data modifying unit modifies the print data such that overlapped region print data corresponding to the overlapped region is deleted from the print data.

3. The complex data processing device according to claim 2, wherein:

the data modifying unit includes a first overlapped region setting unit; and when the overlapped region detecting unit detects multiple overlapped regions, the first overlapped region setting unit sets whether overlapped region print data corresponding to each of multiple overlapped regions is to be deleted from the print data.

4. The complex data processing device according to claim 2, wherein:

the data modifying unit deletes the overlapped region print data from the print data so that a width of the overlapped region is modified by a predetermined amount in one of a direction where the overlapped region is reduced and a direction where the overlapped region is expanded.

5. The complex data processing device according to claim 1, wherein:

the data modifying unit modifies the embroidery data such that overlapped region embroidery data is deleted from the embroidery data.

6. The complex data processing device according to claim 5, wherein:

the data modifying unit includes a second overlapped region setting unit; and when the overlapped region detecting unit detects multiple overlapped regions, the second overlapped region setting unit sets whether overlapped region embroidery data corresponding to each of multiple overlapped regions is to be deleted from the embroidery data.

7. The complex data processing device according to claim 5, wherein:

the data modifying unit deletes the overlapped region embroidery data from the embroidery data so that a width of the overlapped region is modified by a predetermined amount in one of a direction where the overlapped region is reduced and a direction where the overlapped region is expanded.

8. A complex data processing device that processes embroidery data representing an embroidery pattern to be formed on fabric by a sewing machine capable of embroidering and print data representing print pattern to be printed on the fabric by a printer, the complex data processing device comprising:

a data acquiring unit that acquires the embroidery data and the print data;

an overlapped region detecting unit that detects an overlapped region at which an embroidery region represented by the embroidery data and a printing region represented by the print data overlap based on the embroidery data and the print data acquired by the data acquiring unit; and a process order setting unit allowing a user to set the order of embroidering based on the embroidery data and printing based on the print data when the overlapped region detecting unit detects the overlapped region, the processing order setting unit storing the order set by the user.

9. The complex data processing device according to claim 8, further comprising:

a data modifying unit configured to delete overlapped region print data corresponding to the overlapped region from the print data if it is set through the process order setting unit that the printing is performed prior to the embroidering.

10. The complex data processing device according to claim 8, further comprising:

a thread density compensating unit configured to modify the embroidery data to change a thread density at the overlapped region, the thread density compensating unit modifying the embroidery data to increase the thread density of the embroidery at the overlapped region if it is set through the process order setting unit that the printing is performed prior to the embroidering.

11. A computer-readable storage medium storing a computer-executable program, the program usable to cause a computer to serve as a complex data processing device that processes embroidery data representing an embroidery pattern to be formed on fabric by a sewing machine capable of embroidering and print data representing print pattern to be printed on the fabric by a printer, the program comprising:

instructions for causing a data acquiring unit to acquire the embroidery data and the print data;

instructions for causing an overlapped region detecting unit to detect an overlapped region at which an embroidery region represented by the embroidery data and a printing region represented by the print data overlap based on the embroidery data and the print data acquired by the data acquiring unit; and instructions for causing a data modifying unit to delete data corresponding to the overlapped region detected by the overlapped region detecting unit from at least one of the embroidery data and the print data.

12. The computer-readable storage medium according to claim 11, wherein the program further comprises:

instructions for causing the data modifying unit to modify the print data such that overlapped region print data corresponding to the overlapped region is deleted from the print data.

13. The computer-readable storage medium according to claim 12, wherein:

the data modifying unit includes a first overlapped region setting unit; and the program further comprises instructions for causing the first overlapped region setting unit to set whether overlapped region print data corresponding to each of multiple overlapped regions is to be deleted from the print data when the overlapped region detecting unit detects multiple overlapped regions.

14. The computer-readable storage medium according to claim 12, wherein the program further comprises:

instructions for causing the data modifying unit to delete the overlapped region print data from the print data so that a width of the overlapped region is modified by a predetermined amount in one of a direction where the overlapped region is reduced and a direction where the overlapped region is expanded.

15. The computer-readable storage medium according to claim 11, wherein the program further comprises:

instructions for causing the data modifying unit to modify the embroidery data such that overlapped region embroidery data is deleted from the embroidery data.

16. The computer-readable storage medium according to claim 15, wherein:

the data modifying unit includes a second overlapped region setting unit; and the program further comprises instructions for causing the second overlapped region setting unit to set whether overlapped region embroidery data corresponding to each of multiple overlapped regions is to be deleted from the embroidery data when the overlapped region detecting unit detects multiple overlapped regions.

17. The computer-readable storage medium according to claim 15, wherein the program further comprises:

instructions for causing the data modifying unit to delete the overlapped region embroidery data from the embroidery data so that a width of the overlapped region is modified by a predetermined amount in one of a direction where the overlapped region is reduced and a direction where the overlapped region is expanded.

18. A computer-readable storage medium storing a computer-executable usable to cause a computer to serve as complex data processing device that processes embroidery data representing an embroidery pattern to be formed on fabric by a sewing machine capable of embroidering and print data representing print pattern to be printed on the fabric by a printer, the program comprising:

instructions for causing a data acquiring unit to acquire the embroidery data and the print data;

instructions for causing an overlapped region detecting unit to detect an overlapped region at which an embroidery region represented by the embroidery data and a printing region represented by the print data overlap based on the embroidery data and the print data acquired by the data acquiring unit;

instructions for causing a process order setting unit to allow a user to set the order of embroidering based on the embroidery data and printing based on the print data when the overlapped region detecting unit detects the overlapped region; and instructions for causing the processing order setting unit to store the order set by the user.

19. The computer-readable storage medium according to claim 18, wherein the program further comprises:

instructions for causing a data modifying unit to delete overlapped region print data corresponding to the overlapped region from the print data if it is set through the process order setting unit that the printing is performed prior to the embroidering.

20. The computer-readable storage medium according to claim 18, wherein the program further comprises:

instructions for causing a thread density compensating unit to modify the embroidery data to change a thread density at the overlapped region; and instructions for causing the thread density compensating unit to modify the embroidery data to increase the thread density of the embroidery at the overlapped region if it is set through the process order setting unit that the printing is performed prior to the embroidering.

* * * * *